United States Patent [19]

Kosaka

[11] Patent Number: 4,757,047

[45] Date of Patent: Jul. 12, 1988

[54] SUBLIMATION-TYPE THERMAL TRANSFER IMAGE RECEIVING PAPER

[75] Inventor: Takao Kosaka, Himeji, Japan

[73] Assignee: Mitsubishi Paper Mills, Ltd., Tokyo, Japan

[21] Appl. No.: 895,431

[22] Filed: Aug. 11, 1986

[30] Foreign Application Priority Data

Aug. 12, 1985 [JP] Japan ..... 60-178363

[51] Int. Cl.[4] ..... B41M 5/035; B41M 5/26

[52] U.S. Cl. ..... 503;227; 8/471; 428/342; 428/481; 428/913

[58] Field of Search ..... 8/470, 471; 428/195, 428/480, 913, 914, 342, 481; 430/945; 503/227

[56] References Cited

U.S. PATENT DOCUMENTS 4,054,712 10/1977 Nagashima et al. ..... 428/481
4,474,859 10/1984 Oshima et al. ..... 428/913
4,490,435 12/1985 Oshima et al. ..... 8/471

FOREIGN PATENT DOCUMENTS 0212394 10/1985 Japan ..... 428/195

*Primary Examiner*—Bruce H. Hess
*Attorney, Agent, or Firm*—Cushman, Darby & Cushman

[57] ABSTRACT

A higher fatty acid amide(s) is(are) additionally contained in the image receiving layer containing a saturated polyester of a sublimation type thermal transfer image receiving paper. This makes it possible to obtain a uniform printed image with improved color density.

5 Claims, No Drawings

SUBLIMATION-TYPE THERMAL TRANSFER IMAGE RECEIVING PAPER

TECHNICAL FIELD

This invention relates to a sublimation type thermal transfer image receiving paper. More particularly, it relates to a sublimation type thermal transfer image receiving paper suited for use in a sublimation type thermal transfer recording system for obtaining a recorded image by heating the coloring materials on a thin support by a thermal head or other means and thereby sublimating and transferring said coloring materials.

PRIOR ART

According to the sublimation type thermal transfer recording system, a coloring material sheet made by applying the sublimable coloring materials on a thin support such as paper is placed in opposition to a thermal transfer image receiving paper and said sheet is heated by a thermal head for effecting color development and transfer of said coloring materials to thereby obtain a recorded image on the image receiving paper.

It is possible to obtain full-color hard copies by adopting the colors of yellow, magenta, cyan and if necessary black for the respective coloring materials and successively heating and transferring them. As the image receiving paper used in such recording system, it is known to form such paper by providing a coating layer containing a saturated polyester on a support as for instance disclosed in Japanese Patent Kokai (Laid-Open) No. 107885/82.

It is possible with this recording system to obtain a high-quality image of excellent color tone, but according to this system, since the sublimable coloring materials are sublimated directly, a large amount of heating energy is required for sublimating the coloring materials and well satisfactory color density is not obtained by use of an image receiving paper made by simply providing a coating layer containing a saturated polyester on a support.

It is therefore an object of this invention to provide a sublimation type thermal transfer image receiving paper improved in color forming characteristics.

DISCLOSURE OF THE INVENTION

The object of the present invention can be attained by further incorporating a higher fatty acid amide in the saturated polyester-containing layer of a sublimation type thermal transfer image receiving paper.

DETAILED DESCRIPTION OF THE INVENTION

The higher fatty acid amides usable in this invention include, for example, stearic acid amide, palmitic acid amide, oleic acid amide, methylolated stearoamide, ethylenebisstearoamide, methylenebisstearoamide, and the like. These amides may be used in combination or as a mixture.

Use of such higher fatty acid amide(s) in a too small amount proves to be ineffective, while use thereof in an excess amount may deteriorate the color forming characteristics of the produced paper due to the diluting effect. It is thus recommended to use said higher fatty acid amide(s) in an amount of 50 to 300% by weight, preferably 80 to 200% by weight, based on the saturated polyester.

The saturated polyester used in this invention is a linear high-molecular saturated polyester formed by condensation polymerization of a dibasic acid and a dihydric alcohol. A typical example of such polyester is polyethylene terephthalate obtained by polycondensing terephthalic acid and ethylene glycol. It is also possible to use a saturated polyester made by randomly copolymerizing two or more different materials with said dibasic acid and dihydric alcohol for the improvements of crystallinity, melting point, solubility, etc.

Among other examples of said saturated polyesters are polybutylene terephthalate and poly-1,4-cyclohexanedimethylene-ethylene terephthalate. These polyesters may be used in the form of an organic solvent solution, but it is preferred to use them as a water dispersion from the viewpoint of industrial productivity. It is also desirable to use a water-soluble polyester such as a copolymer polyester of a carboxylic acid mixed with a sulfonated phthalic acid isomer and ethylene glycol.

The sublimable coloring materials used in this invention are preferably those having a sublimation point in the range of 70° to 400° C., more preferably 150° to 250° C. Examples of such sublimable coloring materials are disperse dyes such as disperse blue 20 (available under the trade name of "Duranol Blue 2G"), disperse yellow 42 ("Resulin Yellow GR"), disperse red 1 ("Celiton Scarlet B"), etc., quinalizarin dyes, dispersible monoazo dyes, dispersible anthraquinone dyes, dispersible nitrodiphenylamine dyes, and anthracene dyes.

As the support of said sublimable coloring materials, it is recommended to use a thin sheet or tissue-like article which has as high a heat conductivity as possible for the effective heat transfer from the thermal head. Papers such as condenser paper, grassine paper, etc., synthetic paper, synthetic resin film and the like can be used as said support. Synthetic resin film is preferred in terms of uniformity of image quality.

Fine particles of inorganic materials such as silica, calcium carbonate, kaolin, clay, colloidal silica, etc., may be added to the support for preventing heat fusion between the coloring material sheet and the image receiving paper.

The amount of the inorganic particles that can be added to the support is preferably from 25 to 100% by weight based on the total amount of saturated polyester and higher fatty acid amide(s). If the amount of said inorganic particles added is less than 25% in said weight ratio, their effect of preventing heat fusion between coloring material sheet and image receiving paper is unsatisfactory. Also, the stability of movement of the produced sheet and its releasability from the image receiving paper prove unsatisfactory. Further, it tends to occur that the desired thermal transfer of the heat-sublimated dye alone is not effected but the whole of the image receiving layer is transferred. If the amount of said inorganic particles added exceeds 100% by weight, no betterment of the heat fusion preventive effect is given and rather the color density is reduced.

In the preparation of the coloring material sheet, an adhesive having no likelihood of hindering sublimation is used. It is made into an ink, and a dye sheet can be formed by gravure printing or other means.

The support of the image receiving layer used in this invention should be one which has a good surface smoothness and a moderate degree of cushioning properties for close attachment to the thermal head. Ordinary paper, surface-coated paper, synthetic paper, synthetic resin film and the like can be used as such support.

For the preparation of the thermal transfer image receiving paper according to this invention, said saturated polyester resin, a solution or a dispersion of said higher fatty acid amide(s) and, if necessary, a high-melting thermoplastic high-molecular adhesive such as cellulose adhesive, starch adhesive, melamine resin adhesive, epoxy resin adhesive, etc., as binder for effecting adhesion to the support are mixed and dispersed and applied on a support. Certain other materials such as silica, kaolin, calcium carbonate, clay, colloidal silica, etc., may be mixed and dispersed for eliminating unstability of movement (of the paper) due to heat fusion or other causes. The coating solution is applied on said support by a coater having an ordinary coating head such as air knife, roll, blade, etc., and then dried to obtain an image receiving paper.

The coating weight of the image receiving layer of the thus obtained image receiving paper is preferably in the range of 2 to 5 g/m$^2$ on bone dry basis. If the coating weight is less than 2 g/m$^2$, thermal transfer of the heat-sublimed dye may not be effected to a satisfactory degree. A coating weight greater than 5 g/m$^2$ produces no difference in effect as compared with the case of smaller coating weight.

The present invention will hereinafter be described in further detail by way of the examples thereof, but it will be understood that these examples are merely illustrative of the invention but not restrictive thereof.

EXAMPLE 1

10 g each of Kayaset Blue 906 (made by Nippon Kayaku), Kayaset Yellow A-G (Nippon Kayaku) and Kayaset Red B (Nippon Kayaku), which are the dispersable and sublimable coloring materials, 3 g of Vilon #200 (polyester resin mfd. by Toyo Boseki), 2 g of Aerosil R-972 (hydrophobic silica mfd. by Nippon Aerosil), 64 g of toluene and 17 g of methyl ethyl ketone were mixed and pulverized by a ball mill for 24 hours, and the mixture was coated on a 10 micron thick condenser paper to a coating weight of 2 g/m$^2$ by gravure printing and dried to obtain three types of coloring material sheet.

On the other hand, 100 g (solid weight) of Vilomel MD-1200 (water dispersion of polyester resin, mfd. by Toyo Boseki), 150 g (solid weight) of Snowtex C (colloidal silica, mfd. by Nissan Kagaku) and 100 g (solid weight) of Hydrin M-7 (stearic acid amide emulsion, mdf. by Chukyo Yushi) were mixed and dispersed, and the mixture was coated on Peach Coat WP-110 (synthetic paper, mfd. by Nisshin Boseki) to a coating weight of 4 g/m$^2$ by an air knife coater and dried to obtain a thermal transfer image receiving paper.

The coated side of this thermal transfer image receiving paper was placed in opposition to each of said coloring material sheets and printing was conducted on the back side of the coloring material sheet by using a thin film thermal head mfd. by Matsushita Electric Co. at a head voltage of 16 V with a pulse width of 3.4 msec to effect transfer to the image receiving paper. The printed images had high density and uniform quality (See Table 1).

EXAMPLE 2

The same operations as Example 1 were carried out except that B-961 (ethylenebisstearoamide emulsion, made by Chukyo Yushi) was used in place of Hydrin M-7. The results are shown in Table 1.

EXAMPLE 3

The same operations as Example 1 were carried out except that D-130 (methylolamide emulsion, made by Chukyo Yushi) was used in place of Hydrin M-7. The results are shown in Table 1.

EXAMPLE 4

In the operations of Example 2, the amount of B-961 was changed to 250 g. The results are shown in Table 1.

EXAMPLE 5

In the operations of Example 2, the amount of B-961 was changed to 60 g. The results are shown in Table 1.

COMPARATIVE EXAMPLE 1

The operations of Example 1 were carried out without using Hydrin M-7. The results are shown in Table 1.

COMPARATIVE EXAMPLE 2

The operations of Example 1 were carried out by replacing Hydrin M-7 with Celozol A (paraffin emulsion, made by Chukyo Yushi). The results are shown in Table 1.

COMPARATIVE EXAMPLE 3

The operations of Example 1 were carried out by replacing Hydrin M-7 with Permalin PN (polyethylene emulsion, made by Sanyo Kasei). The results are shown in Table 1.

COMPARATIVE EXAMPLE 4

The operations of Example 1 were carried out by replacing Hydrin M-7 with SZ-611 (zinc stearate emulsion, made by Gooh Kagaku). The results are shown in Table 1.

TABLE 1

| | Density* | | | Image** |
|---|---|---|---|---|
| | Cyan | Yellow | Magenta | Uniformity |
| Example 1 | 0.78 | 0.68 | 0.72 | O |
| Example 2 | 0.80 | 0.72 | 0.70 | O |
| Example 3 | 0.76 | 0.67 | 0.71 | O |
| Example 4 | 0.70 | 0.65 | 0.68 | O |
| Example 5 | 0.68 | 0.63 | 0.67 | O |
| Comp. Example 1 | 0.56 | 0.49 | 0.60 | X |
| Comp. Example 2 | 0.61 | 0.52 | 0.63 | X~Δ |
| Comp. Example 3 | 0.62 | 0.53 | 0.64 | X~Δ |
| Comp. Example 4 | 0.57 | 0.50 | 0.60 | X |

*Density was measured by a Macbeth densitometer through the respective color filters.
**Image uniformity was evaluated by visually judging the reproducibility of dots by solid printing.
O: Good.
Δ~X: Not so bad, but unsatisfactory for practical use.
X: Bad.

As seen from Table 1, polyethylene and paraffin wax show a certain degree of effect but are still unsatisfactory for practical applications, while the use of the fatty acid amides according to this invention obviously leads to an improvement of color density and makes it possible to obtain practically sufficient density and uniform printed images.

What is claimed is:

1. A sublimation type thermal transfer recording system comprising:

an image receiving paper; and a coloring material sheet having a layer of heat-sublimable coloring materials, said image receiving layer being provided on a support containing a saturated polyester and one or more higher fatty acid amides.

2. The image receiving paper of claim 1, wherein the higher fatty acid amide(s) is contained in an amount of 50 to 300% by weight based on the saturated polyester.

3. The image receiving paper of claim 2, wherein the image receiving layer further contains the fine particles of at least one inorganic material selected from the group consisting of silica, kaolin, calcium carbonate, clay and colloidal silica.

4. The image receiving paper of claim 3, wherein the fine particles of at least one of said inorganic materials are contained in an amount of 25 to 100% by weight based on the total amount of said higher fatty acid amide(s) and saturated polyester.

5. The image receiving paper of claim 4, wherein the coating weight of the image receiving layer is 2 to 5 $g/m^2$ on the bone dry basis.

* * * * *